US011052457B2

(12) United States Patent
Böcking et al.

(10) Patent No.: US 11,052,457 B2
(45) Date of Patent: Jul. 6, 2021

(54) CASTING NOZZLE

(71) Applicant: SMS group GmbH, Düsseldorf (DE)

(72) Inventors: Sebastian Böcking, Siegen (DE); Guido Fick, Kreuztal (DE)

(73) Assignee: SMS group GmbH, Düsseldorf (DE)

( * ) Notice: Subject to any disclaimer, the term of this patent is extended or adjusted under 35 U.S.C. 154(b) by 134 days.

(21) Appl. No.: 16/464,898

(22) PCT Filed: Nov. 24, 2017

(86) PCT No.: PCT/EP2017/080429
§ 371 (c)(1),
(2) Date: Jun. 19, 2019

(87) PCT Pub. No.: WO2018/099834
PCT Pub. Date: Jun. 7, 2018

(65) Prior Publication Data

US 2019/0299277 A1 Oct. 3, 2019

(30) Foreign Application Priority Data

Nov. 29, 2016 (DE) ..... 10 2016 223 720.9

(51) Int. Cl.
*B22D 11/06* (2006.01)

(52) U.S. Cl.
CPC ..... *B22D 11/0642* (2013.01); *B22D 11/0608* (2013.01); *B22D 11/0657* (2013.01); *B22D 11/0688* (2013.01)

(58) Field of Classification Search
None
See application file for complete search history.

(56) References Cited

U.S. PATENT DOCUMENTS 3,774,670 A 11/1973 Gyöngyös
4,153,101 A * 5/1979 Chateau ..... B22D 11/0642 164/428

(Continued)

FOREIGN PATENT DOCUMENTS

DE 21 31 435 A1 6/1973
EP 0 424 837 B1 5/1997

(Continued)

OTHER PUBLICATIONS

Japanese Office Action dated Jun. 8, 2020, in connection with corresponding JP Application No. 2019-528619 (6 pp., including machine-generated English translation).

(Continued)

*Primary Examiner* — Scott R Kastler
(74) *Attorney, Agent, or Firm* — Maier & Maier, PLLC

(57) ABSTRACT

A casting nozzle for feeding molten metal into a moving casting mold of a caterpillar casting machine, including an elongated housing body having a slot-like outlet side (A), wherein multiple flow passages are formed in the housing body along its longitudinal direction (x) and over its width direction (B), through which passages molten metal can be channeled in the direction of the outlet side (A) and can be fed from there into the moving casting mold, wherein the housing body is of an at least two-part design in the direction of its height and has at least one upper shell and at least one lower shell, wherein the upper shell and the lower shell are spaced apart from one another by separating webs and the individual flow passages extend between the separating webs.

11 Claims, 5 Drawing Sheets

(56) References Cited

U.S. PATENT DOCUMENTS

| | | | | |
|---|---|---|---|---|
| 4,485,835 | A | 12/1984 | Huber et al. | |
| 8,302,663 | B2 | 11/2012 | Eichholz et al. | |
| 2006/0191664 | A1* | 8/2006 | Sulzer ..... | B22D 11/0605 164/481 |

FOREIGN PATENT DOCUMENTS

| | | | |
|---|---|---|---|
| EP | 1 704 005 | B1 | 8/2007 |
| JP | S51-19810 | B1 | 6/1976 |
| JP | S54-110931 | A | 8/1978 |
| JP | S57-165162 | A | 10/1982 |
| JP | S62-183941 | A | 8/1987 |
| JP | H04-41053 | A | 2/1992 |
| JP | H08-117937 | A | 5/1996 |
| JP | 2012-519595 | A | 8/2012 |
| WO | 95/27145 | A1 | 10/1995 |
| WO | 2010/102600 | A1 | 9/2010 |

OTHER PUBLICATIONS

Japanese Search Report dated Apr. 3, 2020, in connection with corresponding JP Application No. 2019-528619 (12 pp., including machine-generated English translation).
International Search Report dated Feb. 23, 2018 in corresponding International application No. PCT/EP2017/080429; 7 pages.

* cited by examiner

CASTING NOZZLE

FIELD

The disclosure relates to a casting nozzle for feeding molten metal into a moving casting mold of a caterpillar casting machine.

BACKGROUND

According to the prior art, particularly for the production of aluminum alloys, horizontal block casting machines are known, which function as a type of circulating caterpillar casting machine. Such a casting machine is known, for example, from EP 1 704 005 B1 or WO 95/27145. In this case, the cooling elements of the casting machine form the wall of a moving casting mold on the straight sections or strands of casting caterpillars, which are arranged opposite one another. The casting caterpillars each consist of a plurality of cooling blocks endlessly connected to one another, which are transported along the circulating tracks of the caterpillar. To this end, the cooling blocks are mounted onto support elements, which are placed onto chains and thus are flexibly connected to one another like links of a chain.

In order to feed molten metal into a moving mold of a block casting machine, casting nozzles are known from the prior art, e.g. from EP 0 424 837 B 1, in which an elongated housing body is interspersed with a plurality of flow passages, which feed into a slot-like outlet side, which is directed toward the moving casting mold. A further common casting nozzle is known from DE 2 131 435 A.

The aforementioned casting nozzles according to the prior art all have a width of about 400-500 mm in common. Accordingly, they have the disadvantage that, when supplying a moving casting mold with a larger width, it is necessary to engage or to operate a plurality as such nozzles next to one another. This can mean that, in the areas in which such casting nozzles border one another laterally, there is no consistent input of molten metal into the moving casting mold, which may result in quality problems with the casting material produced.

SUMMARY

Accordingly, the object of the invention is to obtain a casting nozzle for feeding molten metal into a moving casting mold, in which larger dimensions in the width are possible with mechanically simple and reliable means.

A casting nozzle according to the present invention is used for feeding molten metal, particularly non-ferrous metal, such as, e.g., aluminum or aluminum alloys, into a moving casting mold of a horizontal block casting machine or a caterpillar casting machine, and comprises an elongated housing body with a slot-like outlet side. Within the housing body, along its longitudinal direction and over its width, multiple flow passages are formed, through which passages molten metal can be channeled in the direction of the outlet side and can be fed from there into the moving casting mold. The housing body is of an at least two-part design in the direction of its height and has at least one upper shell and at least one lower shell. In this case, the upper shell and the lower shell, in the mounted state, are spaced apart from one another by separating webs, wherein the individual flow passages within the housing body extend between the separating webs. In its width direction or in the direction of the width of the casting nozzle, the housing body consists of multiple upper shells and lower shells, wherein, at an upper connection point, where two upper shells border one another, an opposite lower shell or a separating web provided thereon has a continuous area. In the same manner, at a lower connection point, where two lower shells border one another, an opposite upper shell or a separating web provided thereon has a continuous area.

The invention is based on the essential knowledge that the housing body consists of a plurality of upper shells and lower shells in its width direction, wherein said upper shells and lower shells are joined together in a sort of "butt joint technique." Specifically, this means that, at a lower connection point, namely where two upper shells border one another, an opposite lower shell or a separating web provided thereon has a continuous area. In the same manner, this also means that, at a lower connection point, namely where two lower shells border one another, an opposite upper shell or a separating web provided thereon likewise has a continuous area. Said "butt joint technique" results from this, according to which vertical separating joints, which form between upper shells and lower shells bordering one another, at no point extend completely over the height (z direction) of the casting nozzle. This leads to considerable stability or stiffness in the housing body in its width direction and thereby enables a considerable increase in the total width of the casting nozzle according to the invention as compared to the previously known prior art. A resulting total width for the casting nozzle according to the invention may thus be greater than 1000 mm, preferably greater than 1500 mm, further preferably greater than 2000 mm.

A further advantage of the previously mentioned "butt joint technique," according to which the housing body is formed in its width direction with the use of a plurality of upper shells and lower shells, is that thus also a plurality of flow passages are formed, which are evenly spaced apart from one another along the width direction of the housing body, i.e. over the total width of the casting nozzle according to the invention. Preferably, the individual flow passages each extend between the separating webs, by means of which the upper shells and the lower shells are spaced apart from one another. Thus, even with the aforementioned large total width of the casting nozzle according to the invention, a consistent input of molten metal into a moving casting mold of a caterpillar casting machine is ensured.

In an advantageous further embodiment of the invention, it may be provided that the respective separating webs, by means of which—when viewed in the direction of the height (z direction) of the housing body—an upper shell and a lower shell are spaced apart from one another, fully extend along the longitudinal direction (x direction) of the housing body and thereby separate the individual flow passages from one another. As a result of this separation, molten metal, which flows through the individual flow passages, cannot flow transversely from one flow passage to another flow passage adjacent thereto. This ensures a harmonic and particularly trouble-free flow behavior of the molten metal within the housing body along its longitudinal direction until it reaches the slot-like outlet side and thus feeds into the moving casting mold. In this manner, the invention differs from a common casting nozzle according to DE 2 131 435 A, in which certain webs, which are arranged between the opposite plates of said casting nozzle, are formed in only a relatively small section thereof as compared to the entire longitudinal extension of said casting nozzle. In this respect, a flow distribution of the molten metal results within the corresponding housing body and its oppositely arranged plates with this casting nozzle according to the prior art, which can lead to turbulence in the flow of the molten metal and thus to an inconsistent feeding into the moving casting mold.

In an advantageous further embodiment of the invention, it may be provided that the separating webs are formed completely on the upper shell, the base areas of which are placed on the opposite lower shell and attached thereto, when the upper shell and the lower shell are mounted together. As an alternative to this, it may also be provided that the separating webs are formed completely on the lower shell, wherein then the base areas of the separating webs are placed on the opposite upper shell and attached to the casting nozzle when in the mounted state. In contrast to the shell element (upper shell or lower shell), on which the separating webs are completely formed, the other respective shell element (lower shell or upper shell) is formed as an even flat body, particularly on both sides, which preferably has a flat extension. Such a shell element in the form of a flat body is advantageous from a production standpoint and can be produced particularly economically. Optionally, the upper shell and the lower shell, each of which is formed respectively as a flat body as previously explained, can also have a curvature along their longitudinal extension.

In an advantageous further embodiment of the invention, it may be provided that both shell elements, i.e. upper shell and lower shell, are formed as a flat body on both sides. In this case, the separating webs are then provided as separate elements, which are placed between the upper shell and lower shell during the mounting thereof and are attached to the upper shell and lower shell. The production of both the upper shell and the lower shell, as a flat body on both sides, is likewise advantageous from a production standpoint and enables production at lower costs.

The aforementioned variants of the casting nozzle according to the invention, according to which at least one shell element (upper shell or lower shell) is formed in the form of a flat body on both sides, also apply mutatis mutandis to the plurality of upper shells and the plurality of lower shells, which are provided along a width of the casting nozzle and from which the housing body is formed in its width direction. This means that the upper shells or the lower shells, from which the housing body is formed in its width direction, may also be formed respectively in the form of flat bodies.

Expediently, the components of the casting nozzle according to the invention, i.e. the upper shells, the lower shells, and the corresponding separating webs, each consist of fire-resistant materials. This assures a long tool life or service life of the casting nozzle according to the invention, particularly with respect to the comparatively high temperatures of the molten metal, which is channeled through the flow passages of the casting nozzle.

By means of the aforementioned form and design of the casting nozzle according to the invention, an adaptation to new requirements is achieved, particularly with consideration of the multipart design of said casting nozzle and the use of fire-resistant materials. In the aforementioned manner, the flow pattern through the individual flow passages within the casting nozzle according to the invention is improved, whereby turbulence in the casting material can be avoided and any existing alloy elements can be evenly distributed, particularly over the width of the casting nozzle.

BRIEF DESCRIPTION OF THE DRAWINGS

A preferred embodiment of the invention is described in the following in detail by means of schematically simplified drawings.

The following is shown.

DETAILED DESCRIPTION

Figure 1:
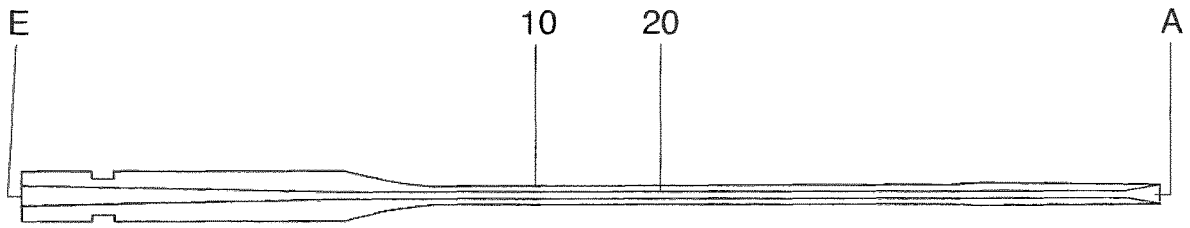
FIG. 1 a side view of a casting nozzle according to the invention.

With reference to FIGS. 1 to 9, the preferred embodiments of a casting nozzle 10 according to the invention, which is used to feed molten metal 11, particularly non-ferrous metals such as, e.g., aluminum or aluminum alloys, into a moving casting mold 12 of a caterpillar casting machine 14, are explained in the following. Equivalent features in the drawing are each provided with the same reference numerals. At this juncture, particular reference is made to the fact that the drawing is merely simplified and particularly not shown to scale.

FIG. 1 shows a side view of the casting nozzle 10 according to the invention, which has a housing body 20 with an inlet side E and an outlet side A. The housing body 20 is of a two-part design in the direction of its height (in the vertical direction in FIG. 1) and comprises in this case at least one upper shell 24 and at least one lower shell 26, which are spaced apart from one another by separating webs 28 (cf. e.g. FIG. 6). Individual flow passages from the inlet side E to the outlet side A extend between said separating webs 28, which is explained in detail in the following.

Figure 10:
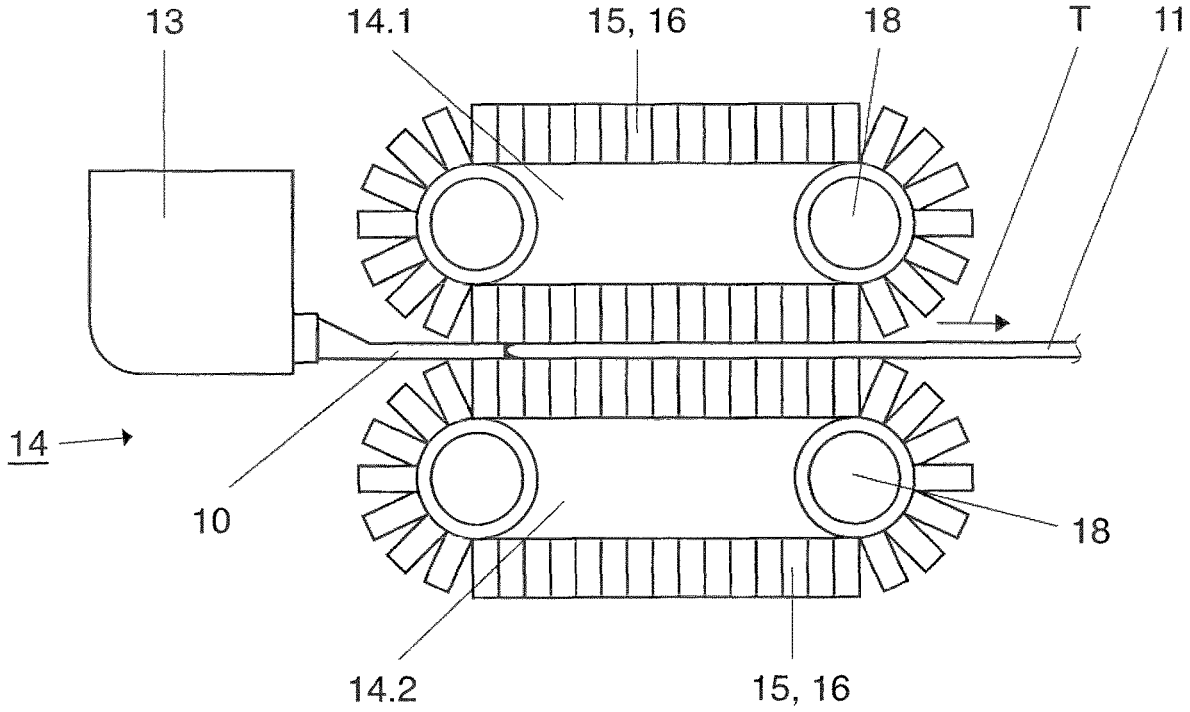
FIG. 10 a side view of a caterpillar casting machine, with which a casting nozzle from FIG. 1 is used.
Figure 11:
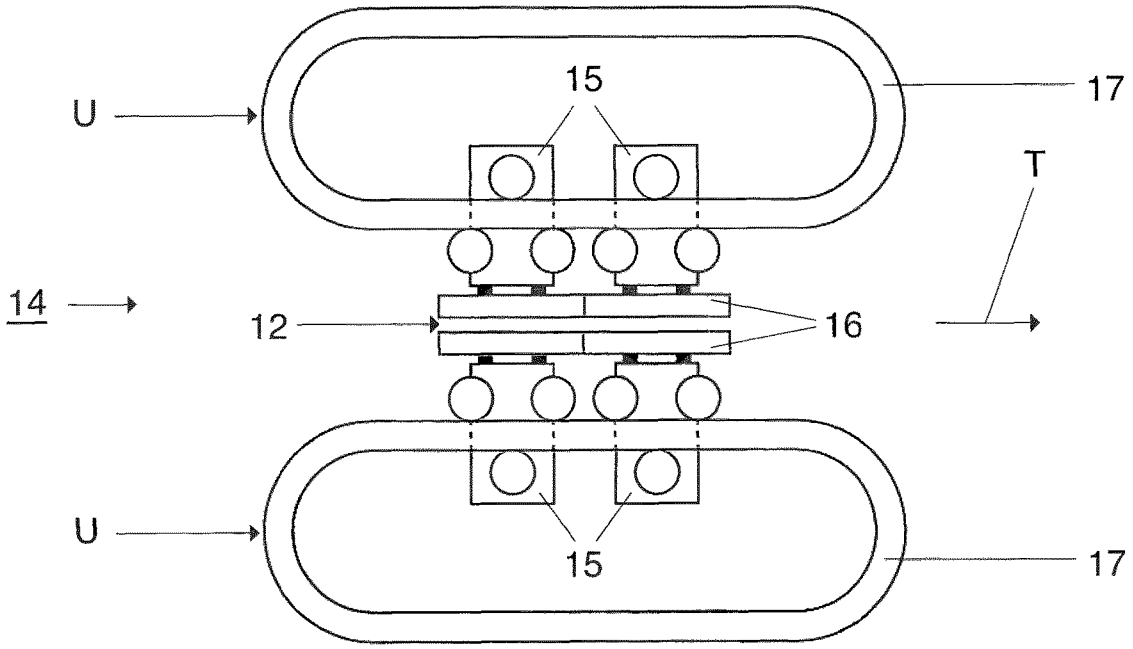
FIG. 11 a side view of two oppositely arranged endless circulating tracks of the caterpillar casting machine from FIG. 10.

FIG. 10 shows a simplified side view of a caterpillar casting machine 14, with which the casting nozzle 10 according to the invention is used. The caterpillar casting machine 14 has an upper caterpillar 14.1 and a lower caterpillar 14.2, each of which is formed from a plurality of support elements 15 and cooling blocks 16 attached thereto. FIG. 11 shows a side view of two guide rails 17, with which two oppositely arranged endless circulating tracks are formed for a caterpillar casting machine 14 of FIG. 10. In this case, a plurality of support elements 15 with cooling blocks 16 attached thereto are guided along each guide rail 17 such that a continuous chain of support elements 15 forms, which are conveyed or transported in the transport direction T along the guide rails 17. Circulation of the upper caterpillar 14.1 and the lower caterpillar 14.2 and the support element 15 attached thereto is ensured by means of allocated drive wheels 18. To illustrate the functional principle of the caterpillar casting machine 14, only two support elements 15, with cooling blocks 16 attached thereto, are shown on the two guide rails 17 in FIG. 11 for simplification purposes.

FIG. 11 further shows that a casting mold 12 is formed between the cooling blocks 16, which reach juxtaposition in the straight sections of the circulating track U of the guide rails 17. In light of the transport direction T of the support elements 15 along the guide rails 17, this casting mold 12 is a moving casting mold. Casting material 11 is produced by casting liquid metal into the moving casting mold 12 by means of the casting nozzle 10 from FIG. 1.

Figure 2:
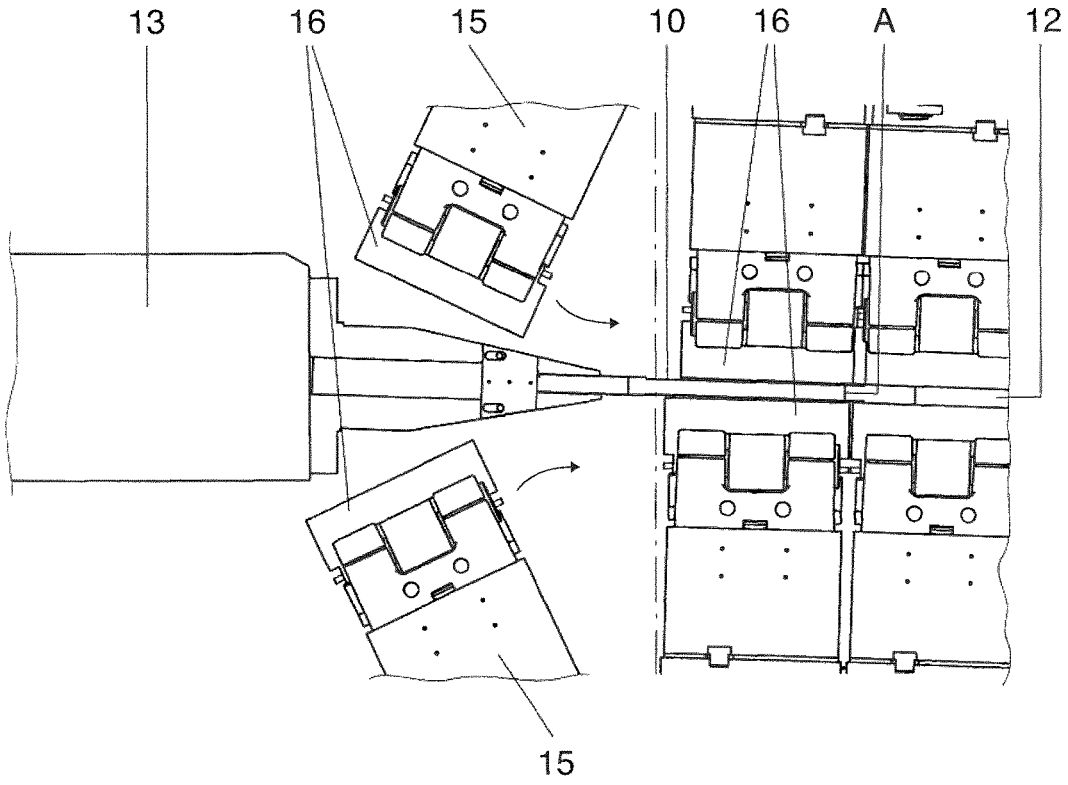
FIG. 2 the use of the casting nozzle from FIG. 1 in a moving casting mold of a caterpillar casting machine.

The use of the casting nozzle 10 with a caterpillar casting machine 14 is again shown in FIG. 2 in an enlarged representation. The inlet side E of the casting nozzle 10 is suitably attached to a melt container 13, in which molten metal is held. Accordingly, the molten metal is routed from the melt container 13 through the casting nozzle 10 attached thereto in the direction of the outlet side A (cf. FIG. 1) of the casting nozzle 10.

Figure 3:
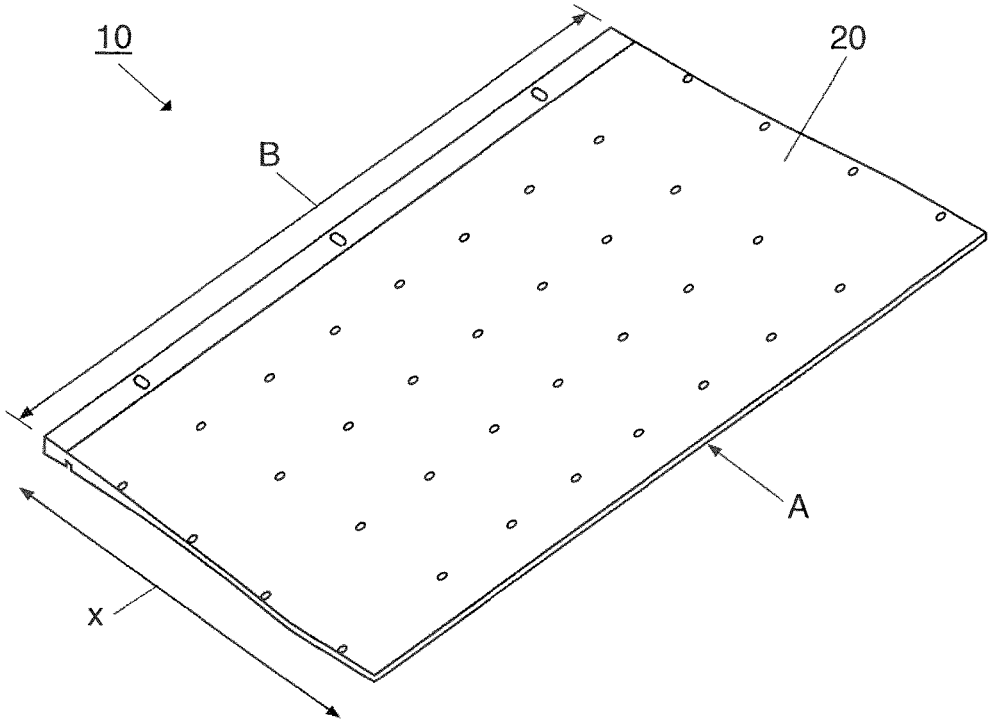
FIG. 3 a perspective view of an upper shell of the casting nozzle from FIG. 1.

FIG. 3 shows the upper shell 24 in a perspective view, from the top right diagonally. The relatively large total width B of the casting nozzle 10 can be seen therein, which is, in any case, larger than a length of the casting nozzle in the longitudinal direction x of the housing body 20. As previously explained, the outlet side A is formed—shown to the right in the figure—which is formed in the form of a slot-like thin rectangular opening in this case. This means that a consistent input of molten metal into a moving casting mold 12 of a caterpillar casting machine 14 is also possible over a considerable width.

The housing body 20 of the casting nozzle 10 is formed from a plurality of upper shells 24 and a plurality of lower shells 26, which are positioned spaced apart from one another in the direction of a height (z direction) of the housing body 20 by means of separating webs 28 (cf. FIGS. 6-9).

Figure 4:
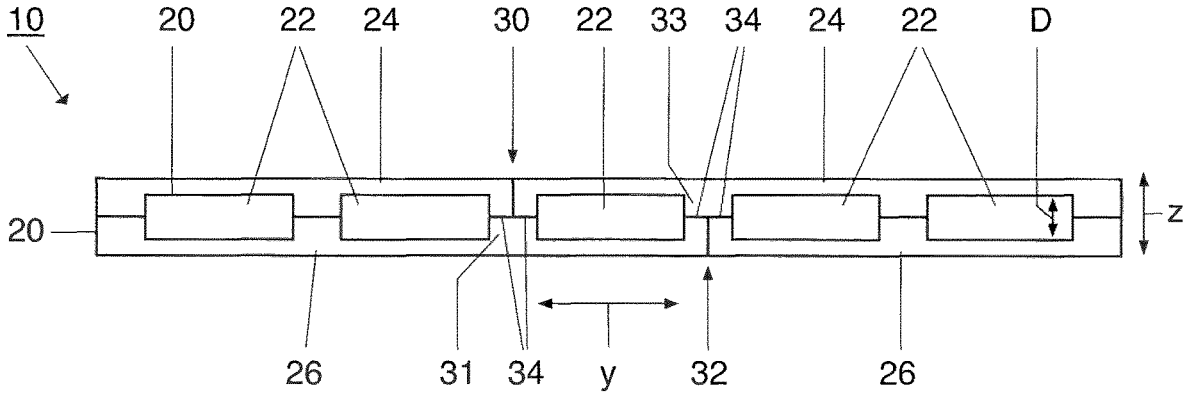
FIG. 4 a side view of an outlet side of the casting nozzle from FIG. 1, from the direction of arrow A in FIG. 3.

FIG. 4 shows a side view of the casting nozzle 10, namely from the direction of arrow A in FIG. 3. In this case, it can be seen that the housing body 20 consists of multiple upper shells 24 and multiple lower shells 26 in the direction of its width (y direction). An essential feature of the invention exists here in that the upper shells 24 and the lower shells 26—when viewed in the width direction y of the housing body 20—overlap laterally and are arranged in a sort of "butt joint technique." This means that, at an upper connection point 30 (cf. FIG. 4), that is at the point where two upper shells 24 border one another, an opposite lower shell 26 has a continuous area 31. In a similar manner, an opposite upper shell 24 has a continuous area 33 at a lower connection point 32, where two lower shells 26 border one another.

The result of this is that the vertical separating joints, which form at the upper connection point 30 and at the lower connection point 32 between the upper shells 24 or the lower shells 26, respectively, do not extend over the entire height of the housing body 20, i.e. in the z direction. As a result of this, stability or stiffness of the housing body 20 is optimized in its width direction y, whereby a comparatively large total width B (cf. FIG. 3) is enabled for the casting nozzle 10.

With respect to the view from FIG. 4, reference is made to the fact that this also may only be a section of a front view from the direction of arrow A in FIG. 3. In this case, the resulting total width B of the casting nozzle 10 is greater than the area which is shown in FIG. 4 for the housing body 20 in its width direction y. Accordingly, the housing body 20 consists of more than two upper shells 24 and lower shells 26, respectively, e.g. of three or more of such shell elements, in its width direction y, wherein the total width, as explained, is greater than is shown in FIG. 4.

The previously mentioned flow passages, which are formed within the housing body 20 between the upper shell(s) 24 and the lower shell(s) 26, each have the reference numeral "22" in FIG. 4. It is advantageous for a consistent flow input of molten metal into a moving casting mold 12 when these individual flow passages 22, each of which exits into the outlet side A of the casting nozzle 10, are spaced apart from one another evenly along the width direction y of the housing body 20.

Figure 5:
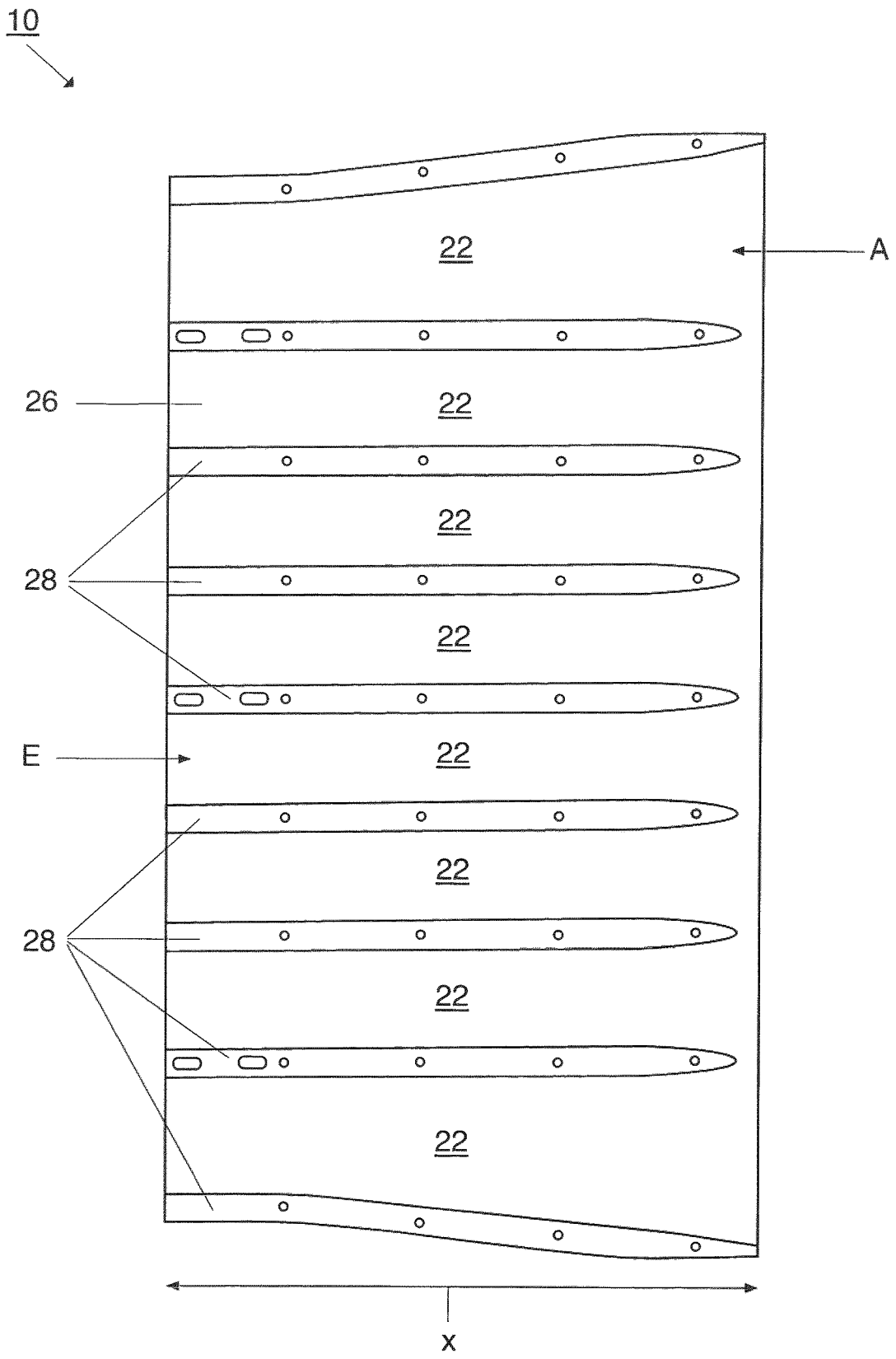
FIG. 5 a top view of an interior surface of a disassembled lower shell of the casting nozzle from FIG. 1.

FIG. 5 shows a top view of the lower shell 26 with the casting nozzle 10 disassembled, namely of the side which is arranged opposite the upper shell 24 when the casting nozzle 10 is disassembled. In other words, FIG. 5 shows a top view of an interior surface of the lower shell 26. It is clear that a plurality of separating webs 28, which extend along the longitudinal axis x of the housing body 20, is formed on a surface of the lower shell 26. If the upper shell 24 and the lower shell 26 are mounted together, a distance between these two shells 24, 26 is defined by a height of these separating webs 28 in the vertical direction (z direction, cf. FIG. 4), wherein the individual flow passages 22 extend between these separating webs 28, namely in the direction of the longitudinal direction x of the casting nozzle 10. FIG. 5 shows that the individual flow passages 22 exit into the outlet side A of the casting nozzle 10.

In the mounted state of the casting nozzle 10, the upper shells 24 and the lower shells 26, which rest against each other with their respective separating webs 28 in the z direction, may be bolted together, for example. To this end, bolts can be used, which permeate the upper shells 24 and the lower shells 26 and the separating webs 28 provided in between in the z direction, and which are indicated respectively by small circles along the separating webs 28 in FIG. 5.

With reference to FIGS. 6-9, various embodiments of the casting nozzle 10 according to the invention are explained in the following, which differ with respect to the design of the separating webs 28. The representations in FIGS. 6-9 respectively show cross-sectional views of the housing body 20 along the width B of the casting nozzle or along the width direction y of the housing body 20.

Figure 6:
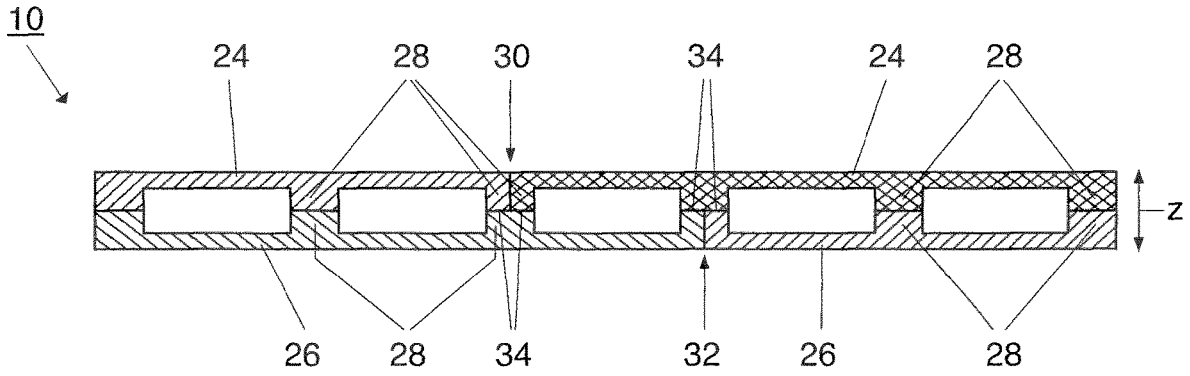
FIG. 6 cross-sectional view through a housing body of the casting nozzle from FIG. 1 or FIG. 3, respectively, along the width B.

According to the embodiment in FIG. 6, both the upper shells 24 and the lower shells 26 have separating webs 28. This corresponds to the representation according to the top view in FIG. 5. In this case, the separating webs 28 are formed on an upper shell 24 or on a lower shell 26—when viewed in the width direction y of the housing body 20—both along the side edges thereof and in a center area thereof. In the mounted state of the casting nozzle 10, the base areas 34 of the separating webs 28 are then placed at the connection points 30, 32, where two upper shells 24 or two lower shells 26 border one another, at the separating webs 28, which are provided on an opposite lower shell 26 or upper shell 24. In this respect, the representation in FIG. 6 corresponds to that in FIG. 4 and illustrates that the vertical separating joints, which are positioned between adjacent upper shells or lower shells, are placed at the connection points 30, 32 and do not extend completely over the height or z direction of the housing body 20. The representation in FIG. 6 further shows that the respective separating webs 28, which are formed both at the upper shells 24 and at the lower shells 26, are arranged oppositely in the mounted state of the casting nozzle 10 and are flush with one another such that the individual flow passages 22 extend between said separating webs 28.

Figure 7:
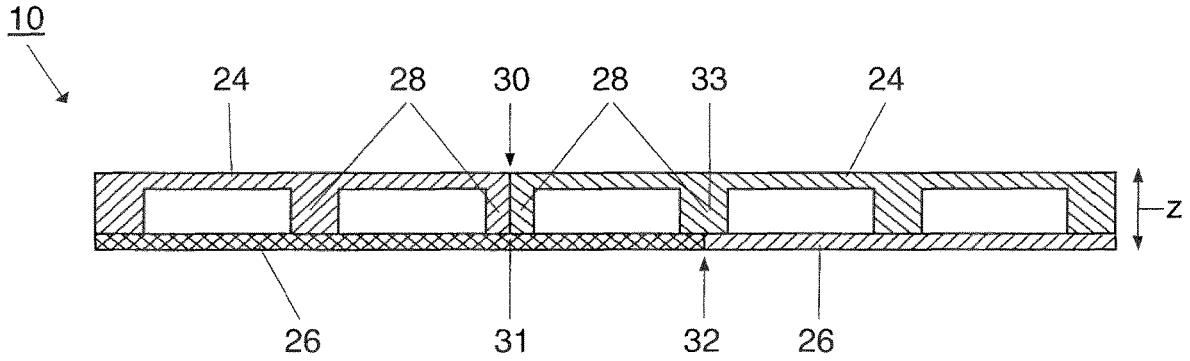
FIG. 7 a cross-sectional view through a housing body of the casting nozzle from FIG. 1 or FIG. 3, respectively, along the width B.

FIG. 7 shows a modified embodiment for the casting nozzle 10, in which the separating webs 28 are formed completely on the upper shells 24. In contrast to this, the lower shells 26 are formed as a flat body. Regardless of this, it remains a fact that, at an upper connection point 30, the separating webs 28, which are formed at side edges of adjacent upper shells 24, respectively, have their base areas 34 placed on a continuous area 31 of an opposite lower shell 26. In the same manner, two adjacent lower shells 26, at a lower connection point 32, are in contact with a continuous area 33 of a separating web 28 of an upper shell 24 arranged opposite thereto.

Figure 8:
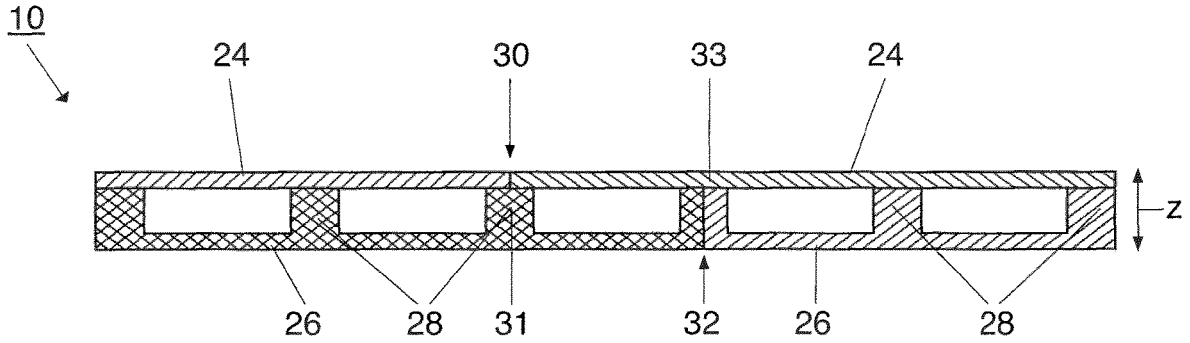
FIG. 8 a cross-sectional view through a housing body of the casting nozzle from FIG. 1 or FIG. 3, respectively, along the width B.

A further embodiment of the casting nozzle 10 is shown in FIG. 8, which corresponds to a kinematic inversion of the embodiment in FIG. 7. With the embodiment from FIG. 8, this means that the separating webs 28 are now formed at the lower shells 26, respectively, wherein the upper shells 24 are formed as flat bodies. The joining of the respective upper shells 24 or lower shells 26 at the upper connection points 30 and the lower connection points 32 corresponds mutatis mutandis to the embodiment in FIG. 7, such that reference is made to the explanation thereof to avoid repetition.

With respect to the embodiments according to FIGS. 6-8, reference is made to the fact that the individual separating webs 28 are of a one-part design with the respective upper shells 24 and lower shells 26. Thus, these upper and lower shells, together with the separating webs, consist of one piece and can be produced, for example, from milling or the like. Accordingly, a separate attaching of the separating webs to the upper and lower shells is not necessary.

Figure 9:
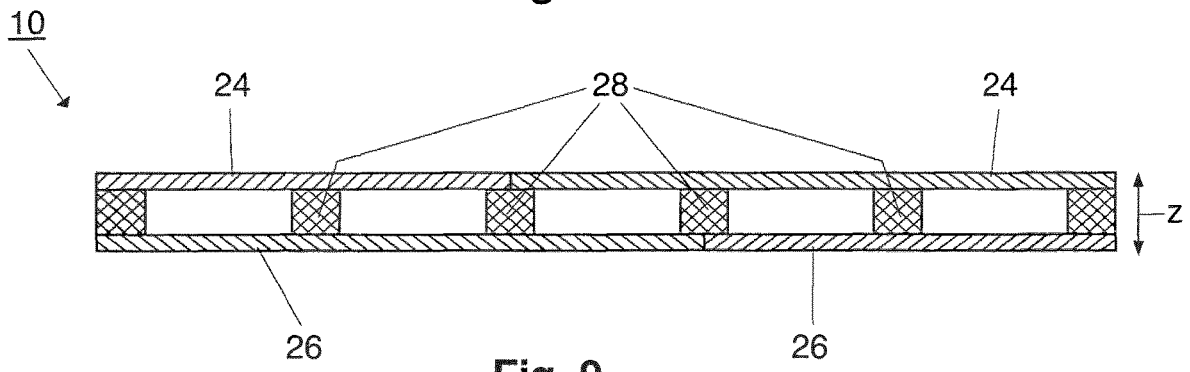
FIG. 9 a cross-sectional view through a housing body of the casting nozzle from FIG. 1 or FIG. 3, respectively, along the width B.

Yet a further embodiment of the casting nozzle 10 is shown in FIG. 9. In this case, all upper shells 24 and lower shells 26, from which the housing body 20 is formed in its width direction y, are each formed as an even flat body. The individual separating webs 28, which are provided between the upper shells 24 and lower shells 26 in the mounted state of the casting nozzle 10, are each formed as separate elements in this case. In the mounted state of the casting nozzle 10, these separate separating webs 28 can be attached to the upper and lower shells 24, 26 as explained, for example, by using bolts, which are indicated by small circles in FIG. 5. In this variant as well, the principle of the explained "butt joint technique" remains applicable with reference to the plurality of upper shells 24 and lower shells 26, which are provided along the width direction y of the housing body 20, according to which the side edges of two adjacent upper shells are aligned at an upper connection point 30 with a continuous area 31 of an opposite lower shell 26. Regarding the side edges of two lower shells 26, which border one another at a lower connection point 32, the same principle applies: In this case, the lower shells are aligned with a continuous area 33 of an opposite upper shell 24.

Finally, reference is made to the fact that a distance between an upper shell 24 and a lower shell 26 in the z direction, and the resulting casting thickness D of the casting nozzle 10 (cf. FIG. 4), is defined by a height of the separating webs 28. Relatively small casting thicknesses D, for example with the value of 8-35 mm, can be realized with the casting nozzle 10 according to the invention.

LIST OF REFERENCE NUMERALS

10 Casting nozzle
11 Molten metal or casting material
12 Casting mold
13 Melt container
14 Caterpillar casting machine
14.1 Upper caterpillar
14.2 Lower caterpillar
15 Support element
16 Cooling block
17 Guide rail
18 Drive wheel
20 Housing body
22 Flow passages (within the housing body 20)
24 Upper shell
26 Lower shell
28 Separating web(s)
30 Upper connection point
31 Continuous area (on) the upper shell 24
32 Lower connection point
33 Continuous area (on) the lower shell 26
34 Base area (of a separating web)
A Outlet side (of the casting nozzle 10)
B Width (of the housing body 20)
D Casting thickness
E Inlet side (of the casting nozzle 10)
T Transport direction (of a support element 18 along the guide rail 16)
U Circulating track (of a guide rail 17)
x Longitudinal direction (of the housing body 20)
y Width direction (of the housing body 20)
z Height direction (of the casting nozzle 10 or of the housing body 20)

The invention claimed is:

1. A casting nozzle for feeding molten metal into a moving casting mold of a caterpillar casting machine, comprising:

an elongated housing body with outlet slot side (A), wherein multiple flow passages are formed in the housing body along its longitudinal direction (x) and over its width direction (y), through which passages molten metal can be channeled in the direction of the outlet slot side (A) and can be fed from there into the moving casting mold, wherein the housing body is of an at least two-part design in the direction of its height (z) and has at least one upper shell and at least one lower shell, wherein the upper shell and the lower shell are spaced apart from one another by separating webs and the individual flow passages extend between the separating webs, wherein the housing body includes multiple upper shells and multiple lower shells in its width direction (y), wherein, at an upper connection point, where two upper shells border one another, an opposite lower shell or a separating web has a continuous area, and wherein, at a lower connection point, where two lower shells border one another, an opposite upper shell or a separating web has a continuous area.

2. The casting nozzle according to claim 1, wherein the upper shells, which border one another in the width direction (y) of the housing body, each have a separating web at least along their side edges, wherein said separating webs have their base areas adjacent one another placed on the continuous area of the opposite lower shell or on separating webs having continuous areas of the lower shell, at the upper connection point, when the upper shells and the lower shells are mounted together.

3. The casting nozzle according to claim 1, wherein the lower shells, which border one another in the width direction (y) of the housing body, each have a separating web at least along their side edges, wherein said separating webs have their base areas adjacent one another placed on the continuous area of the opposite upper shell or on separating webs having continuous areas of the upper shell, at the lower connection point, when the upper shells and the lower shells are mounted together.

4. The casting nozzle according to claim 1, wherein a total width (B) of the housing body is greater than 1000 mm.

5. The casting nozzle according to claim 1, wherein the respective separating webs extend completely along the longitudinal direction (x) of the housing body and the individual flow passages are separate from one another.

6. The casting nozzle according to claim 1, wherein the separating webs are formed completely on the upper shell or completely on the lower shell and their base areas are placed on the opposite shell (lower shell or upper shell) and attached thereto, when the upper shell and the lower shell are mounted together.

7. The casting nozzle according to claim 1, wherein the upper shell and the lower shell are formed as a flat body particularly on both sides, wherein the separating webs are provided as separate elements, which are placed between the upper shell and the lower shell and attached thereto, when they are mounted together.

8. The casting nozzle according to claim 1, wherein a height of the separating webs is formed such that the upper shell and the lower shell adjacent the outlet slot side (A) are spaced 8-35 mm apart from one another such that the resulting casting thickness (D) of the casting nozzle is 8-35 mm, accordingly.

9. The casting nozzle according to claim 1, wherein the separating webs are elongated in the longitudinal direction (x) of the housing body.

10. The casting nozzle according to claim 4, wherein a total width (B) of the housing body is greater than 1500 mm.

11. The casting nozzle according to claim 10, wherein a total width (B) of the housing body is greater than 2000 mm.

* * * * *